US006820283B2

(12) United States Patent
Graneto, III

(10) Patent No.: US 6,820,283 B2
(45) Date of Patent: Nov. 23, 2004

(54) HAIR WASHING SHOWER CAP AND METHOD OF MANUFACTURE

(75) Inventor: Joseph A. Graneto, III, St. Louis, MO (US)

(73) Assignee: Salus Corporation, St. Louis, MO (US)

( * ) Notice: Subject to any disclaimer, the term of this patent is extended or adjusted under 35 U.S.C. 154(b) by 0 days.

(21) Appl. No.: 10/270,403

(22) Filed: Oct. 15, 2002

(65) Prior Publication Data

US 2003/0126670 A1 Jul. 10, 2003

Related U.S. Application Data

(60) Provisional application No. 60/345,188, filed on Jan. 7, 2002.

(51) Int. Cl.[7] ..... A42B 1/04
(52) U.S. Cl. ..... 2/171.2
(58) Field of Search ..... 2/455, 410, 63, 2/68, 171, 171.2, 171.5, 171.8, 181, 174, 202, 906, 918; 132/200, 221, 212, 229, 233, 270, 319

(56) References Cited

U.S. PATENT DOCUMENTS

| | | | | | |
|---|---|---|---|---|---|
| 2,726,398 | A | * | 12/1955 | Cooper | 2/68 |
| 3,996,621 | A | * | 12/1976 | Martienssen | 2/68 |
| 4,289,150 | A | * | 9/1981 | Kimball | 132/270 |
| 4,683,596 | A | * | 8/1987 | Cole | 2/174 |
| 5,249,308 | A | * | 10/1993 | Blume | 2/174 |
| 5,265,278 | A | * | 11/1993 | Watanabe | 2/174 |
| 5,778,455 | A | * | 7/1998 | Joseph | 2/209 |
| 5,850,636 | A | * | 12/1998 | Reuven | 2/174 |
| 5,890,229 | A | * | 4/1999 | Esposito | 2/174 |
| 5,950,636 | A | * | 9/1999 | Hickey | 132/200 |
| 6,216,278 | B1 | * | 4/2001 | Nguyen et al. | 2/174 |

* cited by examiner

*Primary Examiner*—John J. Calvert
*Assistant Examiner*—Alissa L. Hoey
(74) *Attorney, Agent, or Firm*—Armstrong Teasdale LLP

(57) ABSTRACT

A hair washing shower cap and method of manufacture comprising a flexible exterior material laminated with an absorbent interior material and a non-rinse solution on said interior material. The device having an elastic periphery which is capable of elastically constricting about a user's head during use. The device further allows a user to massage the exterior material and easily transfer said massage through said interior material and onto a user's hair or scalp.

20 Claims, 5 Drawing Sheets

HAIR WASHING SHOWER CAP AND METHOD OF MANUFACTURE

This application claims priority of Provisional Patent Application No. 60/345,188, filed Jan. 7, 2002.

BACKGROUND OF THE INVENTION

The present invention relates in general to a device and method for shampooing and conditioning hair or the head without utilizing an external rinsing source and more particularly, to a device in the form of a shower cap which utilizes a laminated interior and exterior material which does not separate during the scalp massage and cleaning action. The device not only presents a unique method of use but also is manufactured with a unique process not heretofore seen in the prior art.

Traditionally, prior art shampoo shower caps utilize two separate exterior and interior materials which are cut separately and sewn together. Typically the exterior material is a waterproof flexible plastic material and the interior material is an absorbent cotton like material which holds the shampoo and conditioner and provides for general cleaning and residue absorbsion. Typically these materials are sewn at the periphery, thereby leaving the materials unconnected elsewhere. The prior art cutting of two separate layers adds expense and time to manufacture since two processes must be used. The prior art further provides a product or device in which the interior material separates from the exterior material, thereby making the exterior massaging action more difficult. This second non-desirable feature of the prior art makes massage of the head or hair difficult when massaging the external portion of the cap. That is, the prior art materials separate during the external massage action and thereby limit the massaging movement of the interior layer.

The present art device utilizes an exterior waterproof or water-resistant material which is pre-laminated with the interior absorbent material. The laminate is then die cut to form a circular/elliptical form prior to placement of an elastic band near the periphery. Thus, the present art assures complete contact and adhesion of the exterior and interior and further allows quick and economical cutting of the product. A rotary or flat die cutter may be utilized to form the laminate.

After die cutting, the elastic band is attached near the periphery of said circular/elliptical cut. The band is preferably sewn in place but may be attached by a variety of other methods. Within the interior is placed a non-rinse shampoo solution that allows cleaning of a person's hair when the exterior is massaged without the need for rinsing.

In operation, a user simply expands the elastic band to fit over a persons head and then places the device over the hair or scalp portion of a persons head. Thereafter the user massages the exterior of the device to clean the hair and/or scalp. The laminated material assures that the exterior massage transfers through to the interior and onto hair/scalp surface. Once removed, the user need not rinse the hair since the shampoo contained therein is of the non-rinse type.

The device may be manufactured from a variety of materials and in numerous shapes and styles. The exterior may be of any flexible material such as plastic, cloth, leather, or paper but is polyethylene in the preferred embodiment. The interior laminated to said exterior may comprise any absorbent cloth, cotton, plastic, leather, or paper but is a non-woven cloth in the preferred embodiment. The elastic band is a staple item which is commercially available as a stretchable strip.

Accordingly, it is an object of the present invention to provide a hair washing shower cap which is manufactured from a single laminated sheet material having an interior layer which is absorbent and which does not separate from the exterior layer during normal use.

Another object of the present invention is to provide a method of manufacturing a shower cap which provides an interior absorbent layer and an exterior substantially water resistant layer which are bonded together in such a manner as to not separate during use.

A further object of the present invention is to provide a hair washing shower cap having a non-rinse shampoo solution on an interior portion that allows cleaning of a person's hair or scalp when the exterior is massaged without the need for rinsing.

A further object of the present invention is to provide a hair washing shower cap having in the alternative a conditioning, hair coloring, or insecticide solution on an interior portion.

A still further object of the present invention is to provide a method of manufacturing a shower cap utilizing a die cut process to form the outline of the cap prior to elastic placement.

SUMMARY OF THE INVENTION

To accomplish the foregoing and other objects of this invention there is provided a Hair washing shower cap and method of manufacture. The device and method provides for shampooing and conditioning of the hair or the head without utilizing an external rinsing or water source. The method of manufacture utilizes a laminated interior and exterior material which prohibits separation of the interior from the exterior, thereby maximizing massage transfer through the exterior layer and interior layer and onto the scalp.

The present invention represents a self contained hair washing shower cap apparatus and its unique method of manufacture and use. The apparatus represents a cap filled with a non-rinse solution that allows washing of a person's hair and scalp when the cap is placed over the hair/head combination and externally massaged. Alternative embodiments may place a conditioner, hair dye, or a lice killing insecticide within the interior of said cap. The apparatus comprises a flexible exterior material which is uniquely laminated with an interior preferably non-woven cloth. The interior retains said non-rinse shampoo or other solution which preferably does not require a water rinse. An elastic and is attached along the periphery which allows the cap to hold onto the head of the person to be washed. Preferably, said band is sewn with said laminated materials, but may be attached with other means such as adhesives, molding, hook and loop fasteners, buttons, or snaps.

A unique aspect of the present invention is its economical and unique method of manufacture. Prior art devices utilize two separate exterior and interior materials which are cut separately and sewn together. This adds expense and time to manufacture since two processes must be used. It further provides a product in which the interior material separates from the exterior material, thereby making the exterior massaging action more difficult. That is, if the user massages the exterior and the interior is separate from the exterior, the massage action does not fully transfer to the hair or scalp of the user.

The present art device utilizes an exterior material which is substantially laminated with the interior material, preferably prior to cutting and forming. The laminate is preferably die cut to form a circular/elliptical form prior to placement of said elastic band. Thus, the present art assures complete contact and adhesion of the exterior and interior and further allows quick and economical cutting of the product. The aforesaid die cutting may utilize a rotary, linear, or flat die cutting process to cut the circular/elliptical cap form. After die cutting, the elastic band is attached near the periphery of said circular/elliptical cut. As aforesaid, said band is preferably sewn in place but may be attached by a variety of other methods.

In operation, a user simply expands the elastic band to fit over a persons head and then places the device over the hair/scalp portion of a persons head. The interior side having a non-rinse shampoo contacts the user's head or hair. Thereafter the user massages the exterior of the device to clean the hair. Once removed, the user need not rinse the hair since the shampoo contained therein is of the non-rinse type.

The device may be manufactured from a variety of materials and in numerous shapes and styles. The exterior may be of any flexible material such as plastic, cloth, leather, or paper but is polyethylene in the preferred embodiment. The interior laminated to said exterior may comprise any absorbent cloth, cotton, plastic, leather, or paper but is a non-woven cloth in the preferred embodiment. The elastic band is a staple item which is commercially available as a stretchable strip. In the preferred embodiment, said exterior is waterproof, water resistant, or impervious to the solution.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
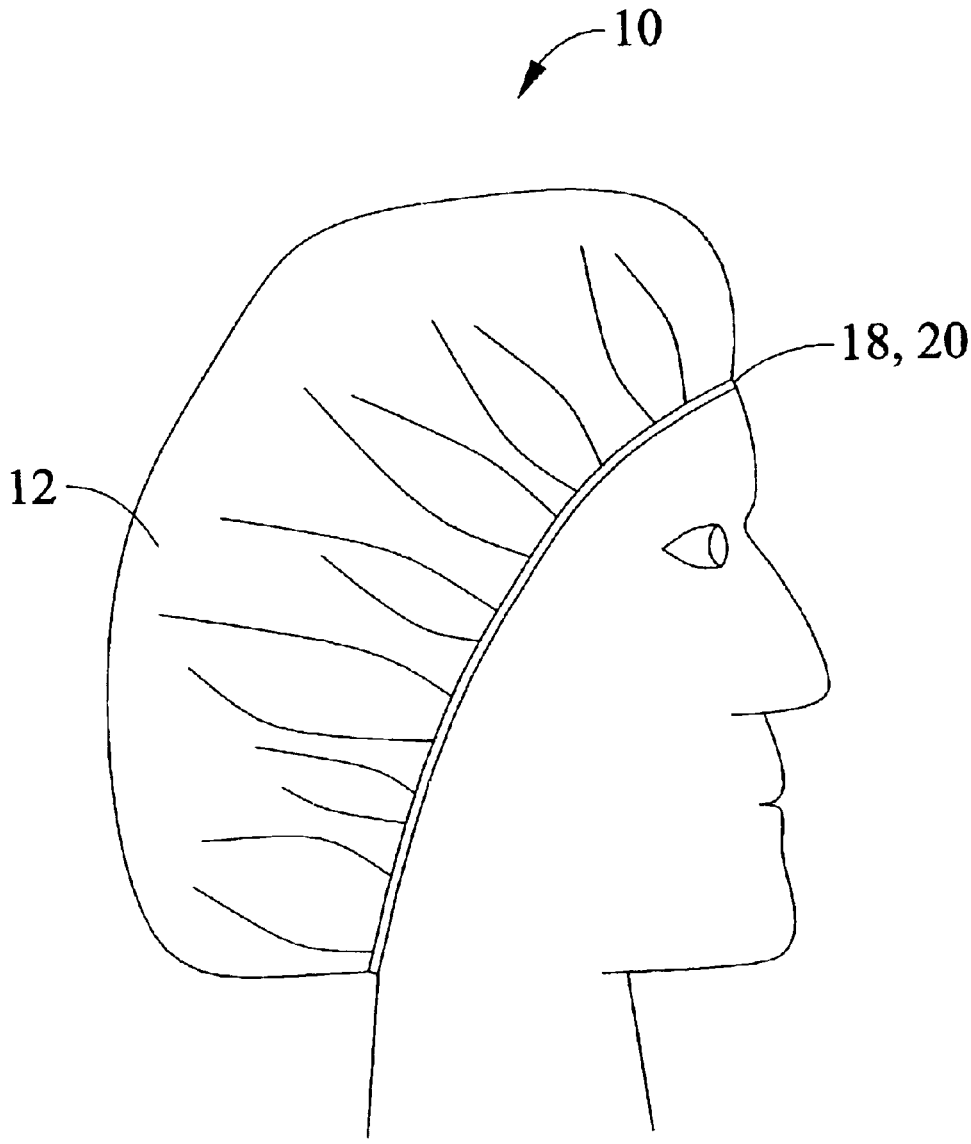
FIG. 1 is a perspective view of the hair washing shower cap apparatus of the present invention on the head of a user.
Figure 2:
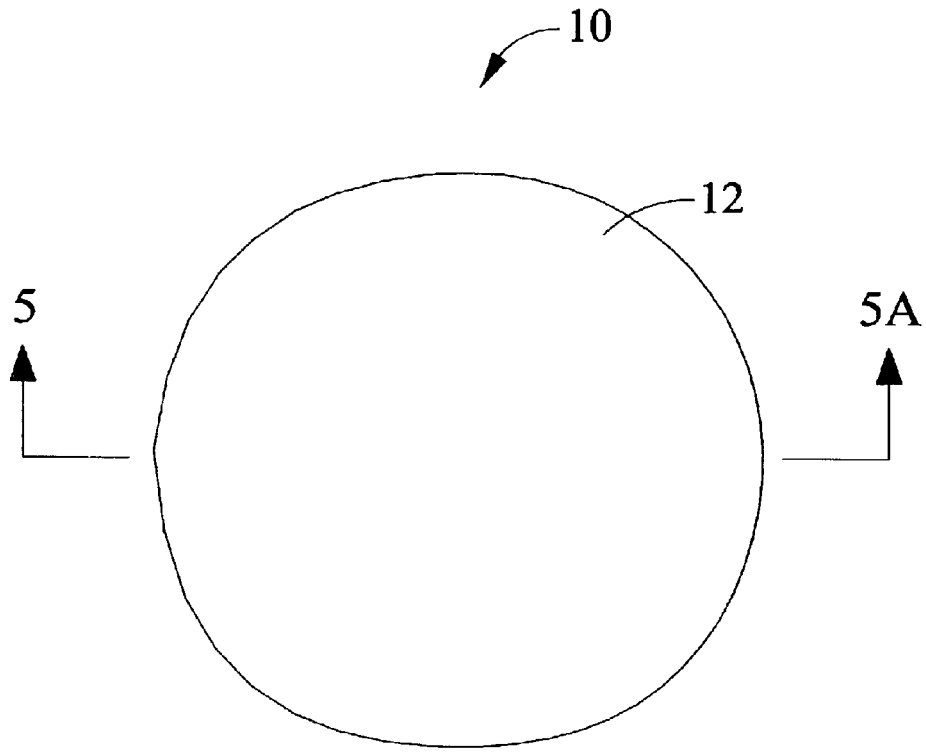
FIG. 2 is a top plan view of the hair washing shower cap apparatus of the present invention with the elastic band and apart from a user. This view shows the exterior material which is laminated onto the interior material.
Figure 3:
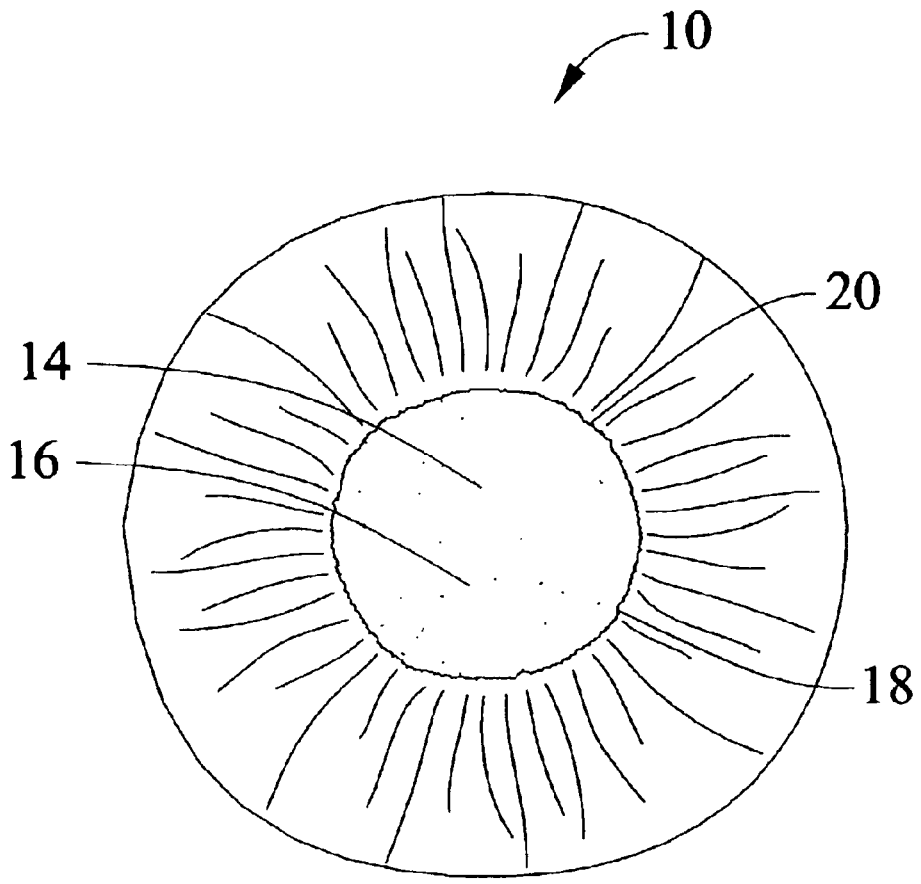
FIG. 3 is a bottom plan view of the hair washing shower cap apparatus of the present invention with the elastic band and apart from a user.
Figure 4:
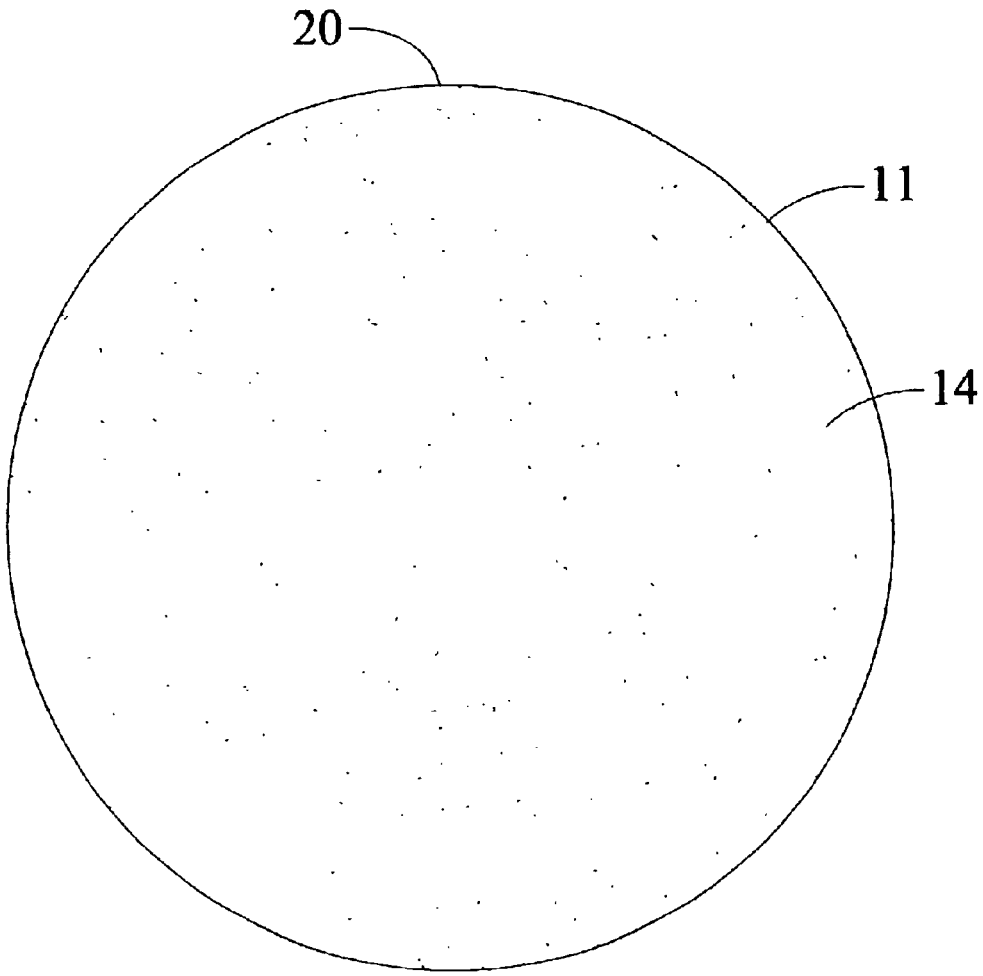
FIG. 4 is an bottom plan view of the hair washing shower cap apparatus of the present invention after die cutting without the elastic band and apart from a user. This view shows the interior material which is laminated onto the exterior material.
Figure 5:
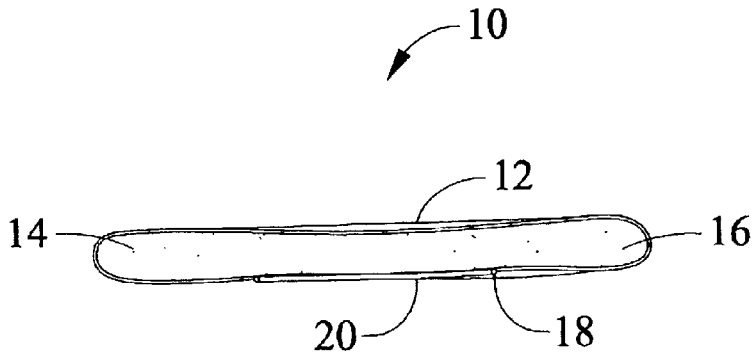
FIG. 5 is a cross sectional view taken along lines 5–5A of FIG. 2 showing the laminated exterior and interior materials and the elastic band in place.

Referring now to the drawings, there is shown in FIGS. 1–5 the hair washing shower cap apparatus 10 which provides for hair washing without rinsing or use of an external water source. The apparatus 10 is particularly adapted for easy, convenient, and effective hair or scalp washing and further allows for easy and economical manufacture.

The drawings show the apparatus 10 comprising, in a preferred embodiment, a substantially elliptical or circular form 11 of laminated flexible exterior sheet material 12 and interior sheet material 14. For the preferred embodiment said form 11 is approximately 19 inches in diameter. Alternative embodiments may utilize diameters or forms of any size, provided the apparatus 10 is able to substantially cover a portion of the user's scalp. The preferred embodiment has an elastic band 18 which is preferably attached near or with a periphery 20 of said form 11. Preferably said band 18 is sewn onto said periphery and compresses the periphery 20 length. Alternative embodiments may attach said band 18 in a plurality of ways including but not limited to adhesives, hook and loop fasteners, slits, snaps, or buttons. In the preferred embodiment, a non-rinse shampoo solution 16 is placed with and on said interior material 14 for cleaning of the scalp and hair. Alternative embodiments, may utilize a conditioner solution, hair coloring solution, or hair lice killing insecticide solution in place of or with said non-rinse shampoo solution 16.

In the preferred embodiment, the apparatus exterior material 12 is flexible and water proof, water resistant, or impervious to the non-rinse solution 16. That is, the exterior material 12 does not allow the shampoo 16, conditioner, or other solution to leak through. The interior material 14 is laminated onto said exterior material 12 whereby massaging action on said exterior material 12 does not separate the interior material 14 and further transfers the external massaging action onto the scalp or hair of the user. In the preferred embodiment, the interior material 14 is of non-woven cloth which is capable of holding the solution 16. Alternative embodiments may utilize other absorbent interior materials 14.

The art of the present invention utilizes a rotary, linear, or flat die to cut the elliptical form 11. Alternative embodiments may utilize forms 11 which are not elliptical without departing from the scope of the present invention, provided the interior 14 and exterior 12 materials are substantially laminated.

In operation, the user expands the elastic band 18 to fit over a persons head and then places the device 10 over the hair portion of a persons head. The interior side 14 contacts the user's head, scalp, or hair. Thereafter the user massages the exterior 12 of the device to clean the hair or scalp. Once removed, the user need not rinse the hair since the shampoo 16 contained therein is of the non-rinse type. In the preferred embodiment said the non-rinse shampoo solution 16 comprises a purified water, phospholipid CDM, isostearamidopropyl morpholine lactate, and fragrance solution. As aforesaid, other solutions such as hair coloring solutions, conditioning solutions, or insecticides may also be utilized.

From the foregoing description, those skilled in the art will appreciate that all objects of the present invention are realized. An apparatus, method of use, and method of manufacture for a hair washing shower cap has been shown and described. The apparatus with its uniquely laminated interior and exterior provides desirable flow through scalp and hair massaging benefits as well as providing for ease of manufacture.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. A hair washing shower cap comprising:

a flexible exterior sheet material of substantially elliptical shape having a periphery;

an absorbent interior sheet material laminated onto said exterior material, such that there is complete contact and adhesion of said interior material to said exterior material an elastic band attached near said periphery; and a solution on said interior material, said cap configured to be positioned on a head of a user such that as said exterior sheet material is touched by a user, said interior sheet material contacts the person's head.

2. The hair washing shower cap as set forth in claim 1 whereby:

said flexible exterior material is substantially impervious to said solution.

3. The hair washing shower cap as set forth in claim 1 whereby:

said interior material is of substantially the same size and form as said exterior material.

4. The hair washing shower cap as set forth in claim 1 whereby:

said interior material is a non-woven cloth capable of holding said solution.

5. The hair washing shower cap as set forth in claim 1 whereby:

said elastic band is attached via sewing.

6. The hair washing shower cap as set forth in claim 1 whereby:

said solution comprises a non-rinse shampoo.

7. The hair washing shower cap as set forth in claim 1 whereby:

said solution comprises a hair-coloring solution.

8. The hair washing shower cap as set forth in claim 1 whereby:

said solution comprises a hair conditioner.

9. The hair washing shower cap as set forth in claim 1 whereby:

said solution comprises an insecticide.

10. A method for cleaning the hair without rinsing, the steps comprising:

laminating an exterior flexible sheet material with an absorbent interior sheet material such that there is complete contact and adhesion of the interior sheet material to the exterior to the exterior sheet material;

cutting the laminated interior and exterior material to a size and form sufficient to cover a substantial portion of a user's head;

forming a periphery having a length on the materials during said cutting;

attaching an elastic band near the periphery whereby in a non-stretched position the band compresses the length of the periphery;

placing a solution onto the interior material;

stretching the elastic band;

placing the interior material over and touching with a user's head;

allowing the elastic band to restrict onto the user's head;

touching the exterior material with the hands of a user such that the interior material touches the person's head;

stretching the elastic band; and removing the interior material, exterior material, solution, and elastic band from the user's head.

11. The method for cleaning the hair without rinsing, as set forth in claim 10, whereby:

said cutting forms a substantially elliptical form.

12. The method for cleaning the hair without rinsing, as set forth in claim 10, whereby:

the solution comprises a non-rinse shampoo.

13. The method for cleaning the hair without rinsing, as set forth in claim 10, whereby:

the interior material is a non-woven cloth capable of holding the solution.

14. A shower cap for washing hair, said cap comprising:

a sheet of material comprising an interior absorbent layer, an exterior substantially water resistant layer, and a periphery, said interior layer bonded to said exterior layer such that there is complete contact and adhesion of said interior layer to said exterior layer; and an elastic band attached near said periphery, said cap configured to be positioned on a head of a person such that said interior layer touches the person's head as said exterior layer is touched by a user.

15. The hair washing shower cap according to claim 14 wherein said interior layer comprises a non-woven cloth capable of holding a liquid, and.

16. The hair washing shower cap according to claim 14 wherein said elastic band is attached via sewing.

17. The hair washing shower cap according to claim 14 wherein said cap comprises a solution on the interior surface, said solution comprises at least one of a non-rinse shampoo, a hair-coloring solution, a hair conditioner, and an insecticide.

18. A method of using a shower cap including a sheet of material having an interior sheet material, an exterior sheet material, a periphery, an elastic band attached near the periphery, and a liquid contained within the shower cap, the interior sheet material comprising an absorbent material and the exterior sheet material substantially impervious to fluids, said method comprising:

positioning the cap on a head of a person such that the interior sheet material touches the head, the cap configured such that the interior sheet material is bonded to the exterior sheet material such that there is complete contact and adhesion of the interior sheet material to the exterior sheet material ; and touching the exterior sheet material with hands of a user to wash the head of the person.

19. A method in accordance with claim 18 further comprising removing the cap from the head of the person.

20. A method in accordance with claim 18 wherein the liquid is at least one of a shampoo, a hair-coloring solution, a hair conditioner solution, and an insecticide solution.

* * * * *